US008446132B2

(12) United States Patent
Yost et al.

(10) Patent No.: US 8,446,132 B2
(45) Date of Patent: May 21, 2013

(54) METHODS AND APPARATUSES FOR ELECTRICAL PULSE ENERGY CAPTURE

(75) Inventors: James L. Yost, Plano, TX (US); John E. Overland, Plymouth, MN (US); Jason A. Christensen, Plymouth, MN (US)

(73) Assignee: Alliant Techsystems Inc., Arlington, VA (US)

( * ) Notice: Subject to any disclaimer, the term of this patent is extended or adjusted under 35 U.S.C. 154(b) by 268 days.

(21) Appl. No.: 13/020,982

(22) Filed: Feb. 4, 2011

(65) Prior Publication Data

US 2012/0200278 A1 Aug. 9, 2012

(51) Int. Cl.
*G05F 1/10* (2006.01)
*G05F 1/652* (2006.01)
*G05F 1/40* (2006.01)

(52) U.S. Cl.
USPC ..... 323/223; 323/222; 323/224; 323/299; 323/282; 323/284; 323/285; 323/286

(58) Field of Classification Search
USPC ..... 323/282, 284, 285, 286, 222, 223, 323/224, 299
See application file for complete search history.

(56) References Cited

U.S. PATENT DOCUMENTS 5,894,102 A 4/1999 Oberlin et al.
6,557,450 B1 5/2003 Cox et al.
6,621,256 B2 9/2003 Muratov et al.
7,015,716 B2 3/2006 Chen et al.
7,077,045 B2 7/2006 Dietrich et al.
7,170,260 B2 1/2007 Thrap
7,629,778 B2 * 12/2009 Liu ..... 323/222
7,654,458 B1 2/2010 Kokodis et al.
7,667,482 B2 2/2010 Mort et al.
7,679,341 B2 * 3/2010 Chen ..... 323/224
7,679,423 B1 3/2010 Nichols
7,791,327 B2 * 9/2010 Liu ..... 323/285
7,884,590 B2 * 2/2011 Liu ..... 323/282
8,049,473 B2 * 11/2011 Hu ..... 323/271
8,253,403 B2 * 8/2012 Chen et al. ..... 323/282
2009/0108815 A1 4/2009 Overland et al.
2009/0153127 A1 * 6/2009 Chen ..... 323/350
2009/0167273 A1 * 7/2009 Liu ..... 323/285
2009/0179625 A1 * 7/2009 Liu ..... 323/285
2010/0013452 A1 * 1/2010 Tang et al. ..... 323/282

* cited by examiner

*Primary Examiner* — Bao Q Vu
(74) *Attorney, Agent, or Firm* — TraskBritt

(57) ABSTRACT

Methods and apparatuses are disclosed for power conversion for fuzes and other electrical power consumers. A current monitor coupled to a power source signal generates a source current indicator. A controller generates a control signal responsive to the source current indicator. A filter well is coupled to the power source signal. An inductive switch circuit switchably grounds a rectified inductive load coupled to an output side of the filter well in response to the control signal, developing a pulsed power signal. A resonance rectifier presents substantially lossless resistive impedance for the pulsed power signal and rectifies the pulsed power signal to charge a charge storage device and generate a power output signal. The filter well, the inductive switch circuit, and the controller maintain the source current indicator within a predetermined current range by filtering the pulsed power signal and adjusting the control signal's frequency responsive to the source current indicator.

30 Claims, 5 Drawing Sheets

METHODS AND APPARATUSES FOR ELECTRICAL PULSE ENERGY CAPTURE

TECHNICAL FIELD

Embodiments of the present invention relate generally to controlling and optimizing delivery of pulsed electrical energy to charge storage devices and, more particularly, to providing electrical energy to bomb fuzes and fuze electronics.

BACKGROUND

The following background description is provided to assist the understanding of the reader. None of the information provided or references cited in this background section is admitted to be prior art to the present invention.

Mission lifetimes for pulse-powered devices, such as gravity bomb fuzes, are limited by the voltage, current, and duration of the host platform's power pulse. In such platforms, a power pulse of a specific voltage and current capability may be provided to a fuze for a limited duration. A limited duration power pulse is equivalent to a discrete amount of energy; it is equivalent to an electrical energy pulse.

Existing pulse energy capture circuits transfer this pulse energy into storage capacitors. However, the theoretical limit of energy captured from a constant current source by the existing capacitor-only pulse energy capture circuits is only 50% of the energy available to be captured, as shown below:

$E_{captured}=\frac{1}{2}(CV^2)$, the total energy capture by a capacitor, where C is the value of the capacitor's capacitance, and V is the voltage across the capacitor.

$E_{available}=V*I*t$, the energy available to be stored, where I is the value of the current available from the source, V is the voltage available from the source, and t is the time duration of the source current pulse.

$I=C(dV/dt)$, the current through the capacitor, where dV/dt is the rate of change of voltage across the capacitor, so solving for C and looking at a fixed increment of time:

$C=(I/V)*t$, therefore substituting this result into the $E_{captured}$ equation above results in:

$$E_{captured}=\frac{1}{2}V*I*t, \text{ therefore, } E_{captured}=\frac{1}{2}E_{available}.$$

In other words, with a basic capacitive storage of a constant current pulsed energy source it is theoretically possible to capture 50% of the energy available. However, in reality, only about 39% of the energy actually may be captured, due to normal losses in the various circuit elements.

A need exists for a circuit technique to increase the amount of energy captured above the 50% efficiency barrier in conventional pulse power bomb fuzes. In other applications, such as electric vehicles powered by energy storage devices, such as capacitors, a need exists to reduce recharging time.

BRIEF SUMMARY

Embodiments of the present invention comprise apparatuses and methods to improve the efficiency of power delivery to charge storage devices and fuze electronics from power delivery elements with a limited amount of power.

An embodiment of the invention comprises a fuze power conversion circuit including a current monitor operably coupled to a power source signal and configured for generating a source current indicator. A controller is configured to generate a control signal responsive to the source current indicator and a filter well is included with an input side operably coupled to the power source signal. An inductive switch circuit is configured for switchably grounding a rectified inductive load coupled to an output side of the filter well responsive to the control signal to develop a pulsed power signal. A resonance rectifier is configured to present a substantially lossless resistive impedance for the pulsed power signal and rectify the pulsed power signal to charge a charge storage device and generate a power output signal. The filter well, the inductive switch circuit, and the controller are configured to maintain the source current indicator within a predetermined current range by filtering the pulsed power signal and adjusting at least one of a frequency and a pulse width modulation of the control signal responsive to the source current indicator.

Another embodiment of the invention includes a current monitor operably coupled to a power source signal and configured for generating a source current indicator. A controller is configured to generate a control signal responsive to the source current indicator. A filter well is included with an input side operably coupled to the power source signal. The filter well includes a pi-type filter with a first inductor operably coupled between the input side and an output side, and a first and second capacitor on each side of the first inductor. A first diode has an anode operably coupled to the output side of the filter well and a second inductor is operably coupled to a cathode of the first diode. A switch is operably coupled in series between the first inductor and a ground. A third capacitor is operably coupled to the second inductor and a third inductor is operably coupled in series with the third capacitor. A second diode has an anode operably coupled between the third capacitor and the third inductor.

Another embodiment of the invention comprises a method for converting power for a fuze. The method includes sensing a current of a power source signal to generate a source current indicator and generating a variable frequency signal responsive to the source current indicator. A rectified inductive load is selectively coupled to a ground responsive to the variable frequency signal to generate a pulsed power signal. The source current indicator is maintained within a predetermined current range by filtering the pulsed power signal relative to the power source signal and modifying a frequency of the variable frequency signal responsive to the source current indicator. The method also includes driving a substantially resistive impedance comprising at least one reactive component with the pulsed power signal, rectifying the pulsed power signal after passing through the substantially resistive impedance, and charging a charge storage device with the rectified pulsed power signal.

DETAILED DESCRIPTION

Figure 1:
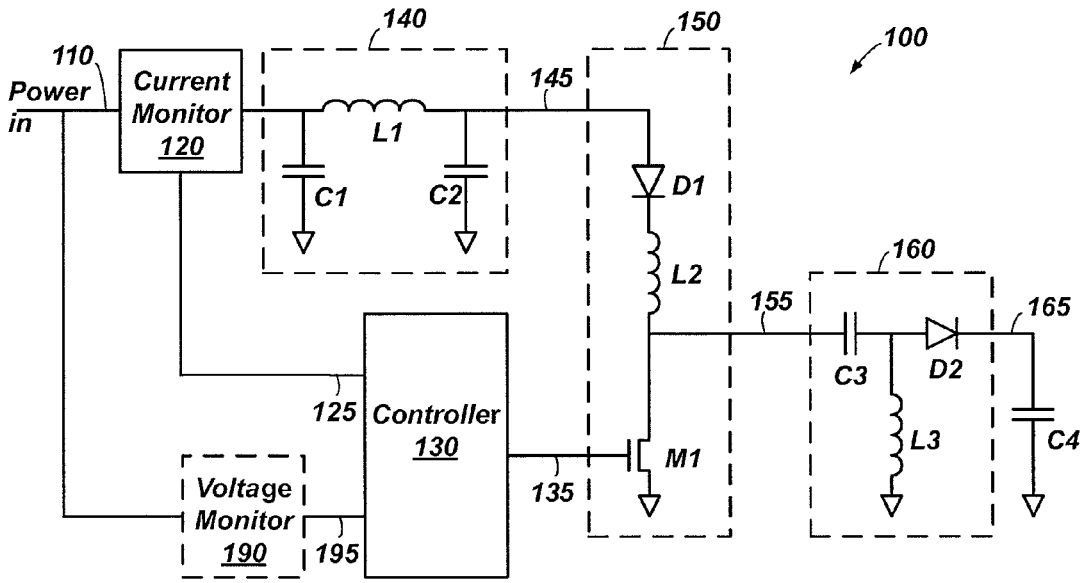
FIG. 1 illustrates a simplified circuit diagram of circuitry used to efficiently extract and store power from a variety of power sources for use in fuze electronics.

In the following detailed description, reference is made to the accompanying drawings which form a part hereof, and in which is shown by way of illustration specific embodiments in which the invention may be practiced. These embodiments are described in sufficient detail to enable those of ordinary skill in the art to practice the invention. It should be understood, however, that the detailed description and the specific examples, while indicating examples of embodiments of the invention, are given by way of illustration only and not by way of limitation. From this disclosure, various substitutions, modifications, additions, rearrangements, or combinations thereof, within the scope of the present invention may be made and will become apparent to those skilled in the art.

In accordance with common practice the various features illustrated in the drawings may not be drawn to scale. The illustrations presented herein are not meant to be actual views of any particular method, device, or system, but are merely idealized representations that are employed to describe various embodiments of the present invention. Accordingly, the dimensions of the various features may be arbitrarily expanded or reduced for clarity. In addition, some of the drawings may be simplified for clarity. Thus, the drawings may not depict all of the components of a given apparatus (e.g., device) or method. In addition, like reference numerals may be used to denote like features throughout the specification and figures.

Those of ordinary skill in the art would understand that information and signals described herein may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof. Some drawings may illustrate signals as a single signal for clarity of presentation and description. It will be understood by a person of ordinary skill in the art that the signal may represent a bus of signals, wherein the bus may have a variety of bit widths and the present invention may be implemented on any number of data signals including a single data signal.

Those of ordinary skill would further appreciate that the various illustrative logical blocks, modules, circuits, and algorithm acts described in connection with embodiments disclosed herein may be implemented as electronic hardware, computer software, or combinations of both. To clearly illustrate this interchangeability of hardware and software, various illustrative components, blocks, modules, circuits, and steps are described generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the embodiments of the invention described herein.

In addition, it is noted that the embodiments may be described in terms of a process that is depicted as a flowchart, a flow diagram, a structure diagram, or a block diagram. A process may correspond to a method, a function, a procedure, a subroutine, a subprogram, etc. Furthermore, the methods disclosed herein may be implemented in hardware, software, or both. If implemented in software, the functions may be stored or transmitted as one or more instructions or code on a computer-readable medium. Computer-readable media may include both computer storage media and communication media including any medium that facilitates transfer of a computer program from one place to another.

It should be understood that any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed there or that the first element must precede the second element in some manner. Also, unless stated otherwise a set of elements may comprise one or more elements.

Elements described herein may include multiple instances of the same element. These elements may be generically indicated by a numerical designator (e.g., 110) and specifically indicated by the numerical indicator followed by an alphabetic designator (e.g., 110A). For ease of following the description, for the most part, element number indicators begin with the number of the drawing on which the elements are introduced or most fully discussed. Thus, for example, element identifiers on a FIG. 1 will be mostly in the numerical format 1xx and elements on a FIG. 4 will be mostly in the numerical format 4xx.

When describing circuit elements, such as, for example, resistors, capacitors, transistors, and electrochemical cells, designators for the circuit elements begin with an element type designator (e.g., R, C, M, EC, respectively) followed by a numeric indicator. Power sources such as, for example, VDD and VCC, as well as ground voltages, may be generically indicated. When appropriate, these power signals may be described in detail. In other cases, the power signals may not be described as it would be apparent to a person of ordinary skill in the art which power signal should be used.

Embodiments of the present invention comprise apparatuses and methods to improve the efficiency of power delivery to charge storage devices and fuze electronics from power delivery elements with a limited amount of power. Other embodiments include the optimization and control of electrical energy delivery to other systems, such as, for example, electric vehicles powered by regenerative braking to supply energy to energy storage devices such as capacitors (i.e., potentially cutting charging times in half).

FIG. 1 illustrates a simplified circuit diagram of circuitry used to efficiently extract and store power from a variety of power sources for use in fuze electronics. A fuze power conversion circuit 100 includes a filter well 140, an inductive switch circuit 150, and a resonance rectifier 160 for receiving electrical power from a power source signal 110, modifying characteristics of the electrical power, and providing the modified electrical power to charge a charge storage device C4 with a power output signal 165.

The power source signal 110 may be configured to deliver an Alternating Current (AC) signal of limited duration or a Direct Current (DC) pulse from a power delivery element (not shown) such as an aircraft, a fuze arming device, or other elements within a fuze. In one example of an application for an embodiment of the present invention, the circuit may be used to provide power to a specific type of bomb fuze. In such a bomb fuze, a DC pulse may be used for the power source signal 110. In some embodiments, pulsed power is applied for a duration equal to or greater than 15 milliseconds and the input current should not exceed 220 milliamps. In addition, the input voltage of the DC pulse may be a minimum of 195 volts, but can be as high as 300 volts. Specifically, for some bomb fuzes the DC pulse may be at 200 volts or at 300 volts. When configured to operate with a DC pulse, embodiments of the present invention may be considered a type of DC-DC converter.

Conventional DC-DC converters generally track a voltage on the output and feed this voltage back to a pulse width modulation control to adjust pulse widths of the current through an inductor to control overall voltage levels on a DC output. Generally, DC-DC converters don't track input voltages and input currents because those parameters are usually less important, or well known, in the overall system and the important factor for the DC-DC converter is to create a stable output at a specified voltage. However, with fuze electronics, the amount of power available is very limited. As a result, it is desirable to capture as much of that energy as possible. In addition, the amount of current or power that may be drawn from the power source signal 110 may be required to be maintained between predefined limits. As discussed above, with many conventional DC-DC converters with a power limit on the input, the energy capture efficiency may be only 50% for charging a capacitor. However, embodiments of the present invention can capture and store as much as 97% of the available energy on a DC pulse input. Of course, not all of the current flowing into the fuze power conversion circuit 100 is captured; some of the current may be "lost" through normal circuit inefficiencies, such as resistance in the windings of the inductors, leakage in capacitors, as well as resistance in traces on a circuit board.

Accordingly, to substantially optimize charging of the charge storage device C4, it may be useful to track the input to the fuze power conversion circuit 100 as a function of voltage, current, or power to better deliver current to the charge storage device C4 for storing energy to be used contemporaneously or later by fuze electronics (not shown). Embodiments of the present invention monitor current on the power source signal 110 and draw substantially near the maximum available power until the charge storage device C4 is fully charged.

A current monitor 120 determines an amount of current flowing on the power source signal 110 and provides a source current indicator 125 as a signal to a controller 130. In some embodiments, the controller 130 compares the source current indicator 125 to a predetermined current range based on parameters for the fuze power conversion circuit 100 and fuze circuitry driven thereby. In other embodiments, the comparison may be performed by the current monitor 120 as explained below. Resulting from the comparison, the controller 130 generates a control signal 135 to control a switch M1 of the inductive switch circuit 150. The control signal 135 may be configured as a variable frequency signal 135 with a frequency of pulses that is varied by the controller to switch M1 in response to the comparison of the source current indicator 125 to maintain the current of the power source signal 110 in the predetermined current range.

In some embodiments, varying the frequency of the pulses on the control signal 135 may develop a more efficient transfer of energy between the power source signal 110 and the charge storage device C4. As a non-limiting example, the combination of the filter well 140 and inductive switch circuit 150 illustrated in FIG. 1, may be configured to more efficiently handle specific pulse widths on the control signal and an amount of power transferred can be adjusted by modifying the frequency of these pulse trains. In other embodiments, a pulse width modulation may be developed by modifying a width of the pulses (high or low) in the pulse train while maintaining the frequency of the pulses constant. In still other embodiments, the pulse width and the frequency of pulses may both be modified.

In some embodiments, different voltage levels may be expected on the power source signal 110. As a result, some embodiments may include a voltage monitor 190 to generate a source voltage indicator 195 as a signal to the controller 130. Depending on power availability and specifications of how much power may be drawn from the power source signal 110, the controller 130 may adjust the control signal 135 based on the voltage on the power source signal 110 and specifications for how much current may be drawn.

The filter well 140 (may also be referred to herein as an "energy well") is configured to efficiently maintain a stable current on the power source signal 110 within a predetermined current range while extracting power from the filter well 140 in pulses based on the control signal 135. An input side is coupled to the power source signal 110 through the current monitor 120 and the filter well 140 is configured as a pi-type circuit with a first capacitor C1 coupled between the input side and a ground and a second capacitor C2 coupled between an output side 145 and ground. A first inductor L1 is coupled between the first capacitor C1 and the second capacitor C2. As a non-limiting example, for an embodiment discussed relative to the simulation results shown herein, the first capacitor C1 is about 0.001 microfarads, the second capacitor C2 is about 0.1 microfarads, and the inductor L1 is about 2000 microhenries.

The filter well 140 is configured to keep the magnetic field in the inductor L1 from collapsing. If the magnetic field of the inductor L1 collapses, the filter well 140 may not be able to accept all the current that can be supplied from the power source signal 110, which would lead to reduced efficiency in capturing the most energy possible from the power source signal 110.

Thus, the filter well 140 stores electrons (energy) in a substantially lossless fashion for extraction on the output side 145 in a pulsed fashion. Since current leads voltage in a capacitor, quick gulps of electrons can be taken out of the second capacitor C2 without stalling the magnetic field build up (i.e., inrush current) in the first inductor L1. As a result, downstream frequency control on the output side 145 results in a choice of output voltages on the output side 145 and a current draw control on the input side 110.

The inductive switch circuit 150 includes a forward-biased first diode D1, a second inductor L2 and the switch M1 all in series between the output side 145 and ground. The switch M1 is illustrated as a Field Effect Transistor (FET) device. However, many other electrically controllable switch types may be used such as, for example, bipolar transistors, Junction Field Effect Transistors (JFETs), relays, and the like. As a non-limiting example, for an embodiment discussed relative to the simulation results shown herein, the second inductor L2 is about 500 microhenries and the switch M1 is an n-channel FET.

The switch M1 is used to enable the flow of current from the output side 145 of the filter well 140 through the first diode D1 and the second inductor L2 when the switch M1 is closed. By repeatedly opening and closing the switch M1 (e.g., from a change in frequency of the pulses on the control signal 135) quick gulps of electrons can be taken out of the second capacitor C2 and stored in a magnetic field of the second inductor L2. Thus, the filter well 140 provides smoothing of a pulsed power signal 155 at an output of the inductive switch circuit 150 such that the current flow drawn from the power source signal 110 can remain relatively stable and at a selectable level depending on the frequency of the control signal 135.

The resonance rectifier 160 receives the pulsed power signal 155, rectifies it with diode D2 and creates the power output signal 165 to charge the charge storage device C4. The resonance rectifier 160 includes a third capacitor C3 in series with a third inductor L3 between the pulsed power signal 155 and ground. The node between the third capacitor C3 and the third inductor L3 couples to the forward-biased diode D2 and then to the charge storage device C4.

A significant problem with charging a capacitor is that the voltage starts out at zero such that, even though current is being supplied, the energy (i.e., I*V) starts out at zero, resulting in inefficient initial charging. The resonance rectifier 160 creates a resonant circuit with the third capacitor C3 and the third inductor L3 such that the load that appears on the pulsed power signal 155 appears resistive, which creates more efficient charging for the charge storage device C4.

The impedance of a circuit includes both real and imaginary components. The resistance (R) of the circuit accounts for the real portion, while the capacitive reactance ($X_C$) and inductive reactance ($X_L$) account for the imaginary portion. Combined, the resistance and reactance is referred to as the impedance (Z) and is defined as $Z^2=R^2+(X_L-X_C)^2$. In order for the energy transfer to be maximized, the circuit impedance should be neither inductive nor capacitive, and should therefore appear as resistive as possible. In other words, the reactive components (i.e., C3 and L3) are configured to oscillate in order to minimize the reactive portion of the impedance and make the impedance appear as a substantially resistive impedance seen by the pulsed power signal 155. The diode D2 rectifies the oscillating signal to present only positive current on the power output signal 165.

With proper component values, the resonance rectifier 160 may be set to provide different voltage levels on the power output signal 165 based on the voltage level and frequency of the pulsed power signal 155. As a non-limiting example, for an embodiment discussed relative to the simulation results shown herein, the third capacitor C3 is about 10 nanofarads and the third inductor L3 is about 100 microhenries. This embodiment can be set to efficiently charge the charge storage device C4 to about 35 volts, as is explained below.

The power output signal 165 may operably couple to the charge storage device C4, which may be, for example, a capacitor, a bank of capacitors, a super-capacitor, or a bank of super-capacitors. The charge storage device C4 may be used to store energy produced by the fuze power conversion circuit for contemporaneous or subsequent use by other electronics in the fuze. In addition, the charge storage device C4 may assist in filtering the power output signal 165 to produce a smoother and more stable DC output on the power output signal 165. Of course, while not shown, a person of ordinary skill in the art will recognize that other passive components such as resistors and additional capacitors (not shown) may be used in filtering the power output signal 165.

Super-capacitors may be better suited for receiving a lower voltage, such as, for example, 5 volts. In contrast, poly capacitors may be better suited for receiving a higher voltage such as, for example, 35 volts or 50 volts. As mentioned, the resonance rectifier 160, in combination with the inductive switch circuit 150 may be tuned to present different voltage levels on the power output signal 165.

The controller 130 may be configured in many different ways, such as, for example, a microprocessor, a microcontroller, or a Field Programmable Gate Array (FPGA). When configured with a microprocessor or a microcontroller, many of the operations performed by the controller 130 may be performed in software. The controller 130 receives the source current indicator 125 and possibly the source voltage indicator 195 and uses the current information and voltage information derived therefrom to determine how to appropriately drive the control signal 135 by modifying a pulse width, a frequency, or a combination thereof for the control signal 135.

Figure 2:
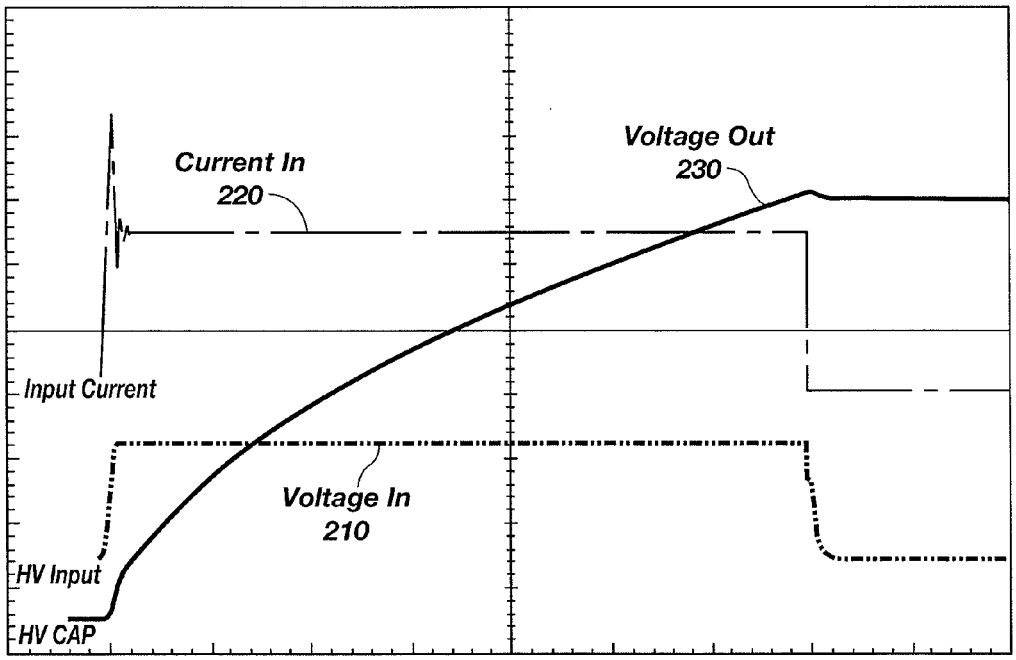
FIG. 2 is a plot illustrating current and voltage on a power input and voltage on a energy storage device.

FIG. 2 is a plot illustrating current and voltage on the power source signal 110 and a voltage on the power output signal 165. With reference to FIGS. 1 and 2, the plot of FIG. 2 illustrates an embodiment wherein the voltage on the power source signal 110 is a DC pulse of about 220 volts as illustrated by waveform 210. The current on the power source signal 110 is controlled by the fuze power conversion circuit 100 to be about 190 milliamps as shown by waveform 220. Waveform 230 illustrates the voltage on the charge storage device C4 rising very quickly at the beginning and then tapering off as the charge storage device C4 becomes fully charged to about 35 volts, indicating an efficient energy transfer between the power source signal 110 and the power output signal 165. In conventional DC-DC converters with a constant current source, the voltage on the charge storage device C4 would rise in a more linear fashion indicating that power is not transferred to the charge storage device C4 as efficiently.

Figure 3:
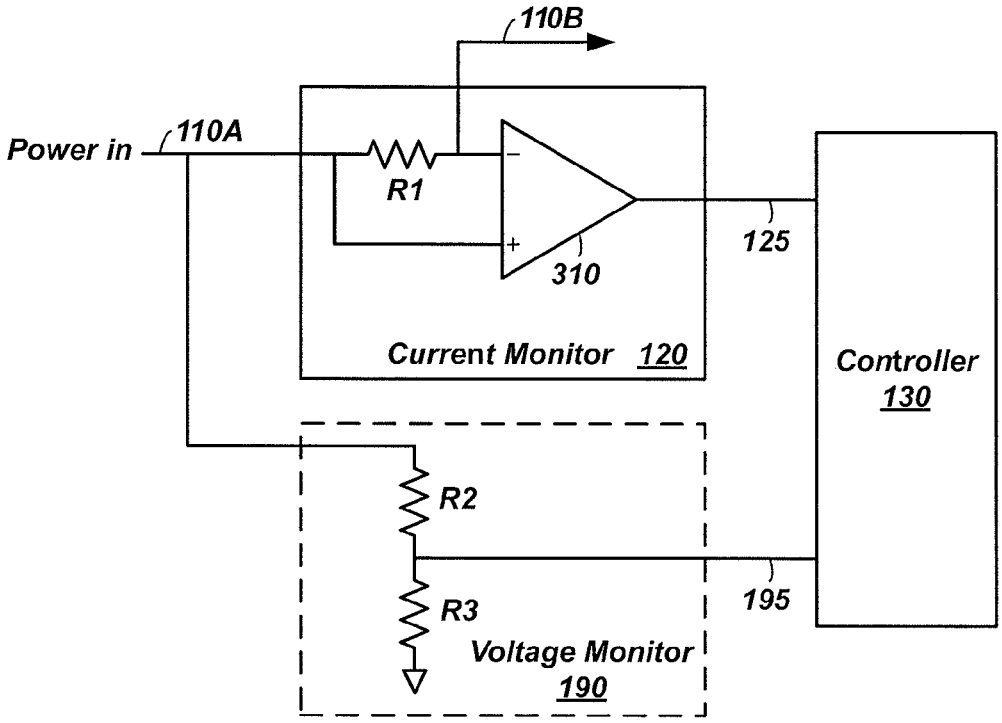
FIG. 3 is a simplified circuit diagram illustrating embodiments of a current monitor and voltage monitor for use in some embodiments of the present invention.

FIG. 3 is a simplified circuit diagram illustrating embodiments of a current monitor 120 and a voltage monitor 190 for use in some embodiments of the present invention. Many different current monitors may be used, such as, for example, Hall-effect current sensors, resistor/amplifier combinations, and resistor/comparator combinations. As a non-limiting example, FIG. 3 illustrates the current monitor 120 generating the source current indicator 125 as an analog signal for presentation to the controller 130. A power source signal 110A is fed through resistor R1, which then feeds the filter well 140 (FIG. 1) as the power source signal 110B. As a result, the voltage drop across resistor R1 is indicative of the amount of current on the power source signal 110B. An amplifier 310 amplifies the voltage drop across resistor R1 to generate the source current indicator 125 as an analog voltage level appropriate for the controller 130.

An optional voltage divider including resistor R2 and resistor R3 in series creates the source voltage indicator 195 as an analog signal proportional to the voltage level on the power source signal 110A and at a voltage level appropriate for the controller 130. In the embodiment of FIG. 3, the controller 130 includes one or more analog-to-digital converters (not shown) to convert the source current indicator 125 to a digital current value and convert the source voltage indicator 195 to a digital voltage value. In other embodiments, the one or more analog-to-digital converters may be discrete parts included in the current monitor 120, the voltage monitor 190, or a combination thereof. As a non-limiting example, some projectiles may supply a DC pulse at 200 volts, while others may supply a DC pulse at 300 volts. In this example, the voltage monitor 190 may be set at a threshold of 250 volts and the controller 130 may adjust the control signal 135 (also referred to herein as a variable frequency signal 135) for a 200 volt pulse or for a 300 volt pulse. For example, to draw a same amount of power for either DC pulse, the controller 130 may reduce the frequency of the control signal 135 for 300 volt pulses relative to 200 volt pulses.

Moreover, a single analog-to-digital converter may be time multiplexed to provide the digital values for both the current and the voltage. To mitigate the impact of short term transient behavior, both the source current indicator 125 and the source voltage indicator 195 may be averaged over a sliding time window to determine an average value for the appropriate indicator over the time window. The averaging may be performed in the analog domain, such as, for example, by appropriate low-pass filtering circuitry. The averaging may also be performed in the digital domain by averaging multiple samples of the digital current value and the digital voltage value over the sliding time window. Providing average values may assist in generating a more stable power output by removing noise or other undesired transients from the raw signals. Of course, the length of the sliding time window may be adjusted depending on the application, the expected variations in signals, and the response time of the feedback loops in the fuze power conversion circuit 100 (FIG. 1).

Other types of current monitors 120 are possible. As another non-limiting example, the voltage drop across R1 may be compared to a first threshold voltage with a comparator to generate a first current indicator. Thus, if the current on the power source signal 110 (FIG. 1) is above the first threshold, the first current indicator will be asserted, and if the current is below the first threshold, the first current indicator will be negated.

Similarly, the voltage drop across R1 may be compared to a second threshold voltage with another comparator to generate a second current indicator. Thus, if the current on the power source signal 110 is above the second threshold, the second current indicator will be asserted, and if the current is below the second threshold, the first current indicator will be negated. In such an embodiment, the controller 130 receives two digital signals indicating characteristics of the current on the power source signal 110. The use of these signals is explained below with reference to FIG. 4.

Figure 4:
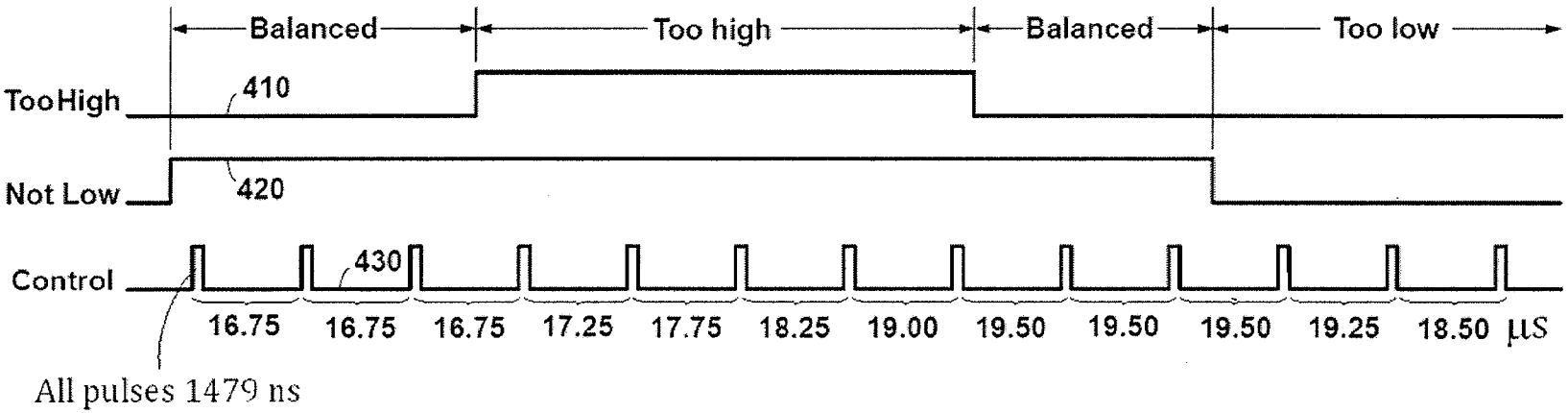
FIG. 4 is a simplified timing diagram of some possible digital control signals according to an embodiment of the present invention.

FIG. 4 is a simplified timing diagram of some possible digital control signals according to an embodiment of the present invention. With reference to FIGS. 1 and 4, signal 410 illustrates a digital control signal indicating that the current in the power source signal 110 is too high relative to the predetermined current range when signal 410 is asserted. Signal 420 illustrates a digital control signal indicating that the current in the power source signal 110 is not too low relative to the predetermined current range when signal 420 is asserted. A combination of signal 410 and signal 420 can, therefore, define time periods when the current is within range (i.e., when signal 410 is negated and signal 420 is asserted), when the current is too high (i.e., when signal 410 is asserted and signal 420 is asserted), and when the current is too low (i.e., when signal 410 is negated and signal 420 is negated). In this particular embodiment, a combination of signal 410 asserted and signal 420 negated should not occur because that would indicate that the current is "too high" and the current is "too low."

In a "balanced" time period (i.e., when the current on the power source signal 110 is within the predetermined current range) waveform 430 indicates that the control signal 135 maintains a pulse train period of about 16.75 microseconds from pulse to pulse. In a "too high" period (i.e., when the current on the power source signal 110 is above the predetermined current range) waveform 430 indicates that the control signal 135 begins increasing the pulse train period as shown in the five consecutive pulses with periods of about 17.25, 17.75, 18.25, 19.00, and 19.50 microseconds. Increasing the pulse train period of the control signal 135 (i.e., reducing the frequency) will cause less current to be drawn from the output side 140 of the filter well 145, which will cause less current to be drawn from the power source signal 110. Since the switch M1 is closed when waveform 430 is high and the switch M1 is open when waveform 430 is low, less current is being drawn during the pulse train period.

The fuze power conversion circuit 100 then enters a balanced period with two consecutive pulses at about 19.50 microseconds. Then, in a "too low" period (i.e., when the current on the power source signal 110 is below the predetermined current range) waveform 430 indicates that the control signal 135 begins decreasing the pulse width as shown in the two consecutive pulses with widths of about 18.50 and 18.00 microseconds.

Of course, other control signals indicative of when the current in the power source signal 110 is within the predetermined range may be used in other embodiments of the invention. These control signals may be generated and provided to the controller, or they may exist as signals or variables within the controller.

FIG. 4 illustrates an example of a fixed pulse width and modification of the frequency of the control signal 135 (FIG. 1). Other embodiments may vary the width of high or low pulses rather than the frequency in a pulse width modulation approach. Moreover, as stated above, varying the frequency of the pulses may develop a more energy efficient transfer of energy between the power source signal 110 (FIG. 1) and the charge storage device C4 (FIG. 1). In such embodiments, the pulses may be a fixed width or the width of the pulses may be modified along with the frequency of the pulses.

Figure 5:
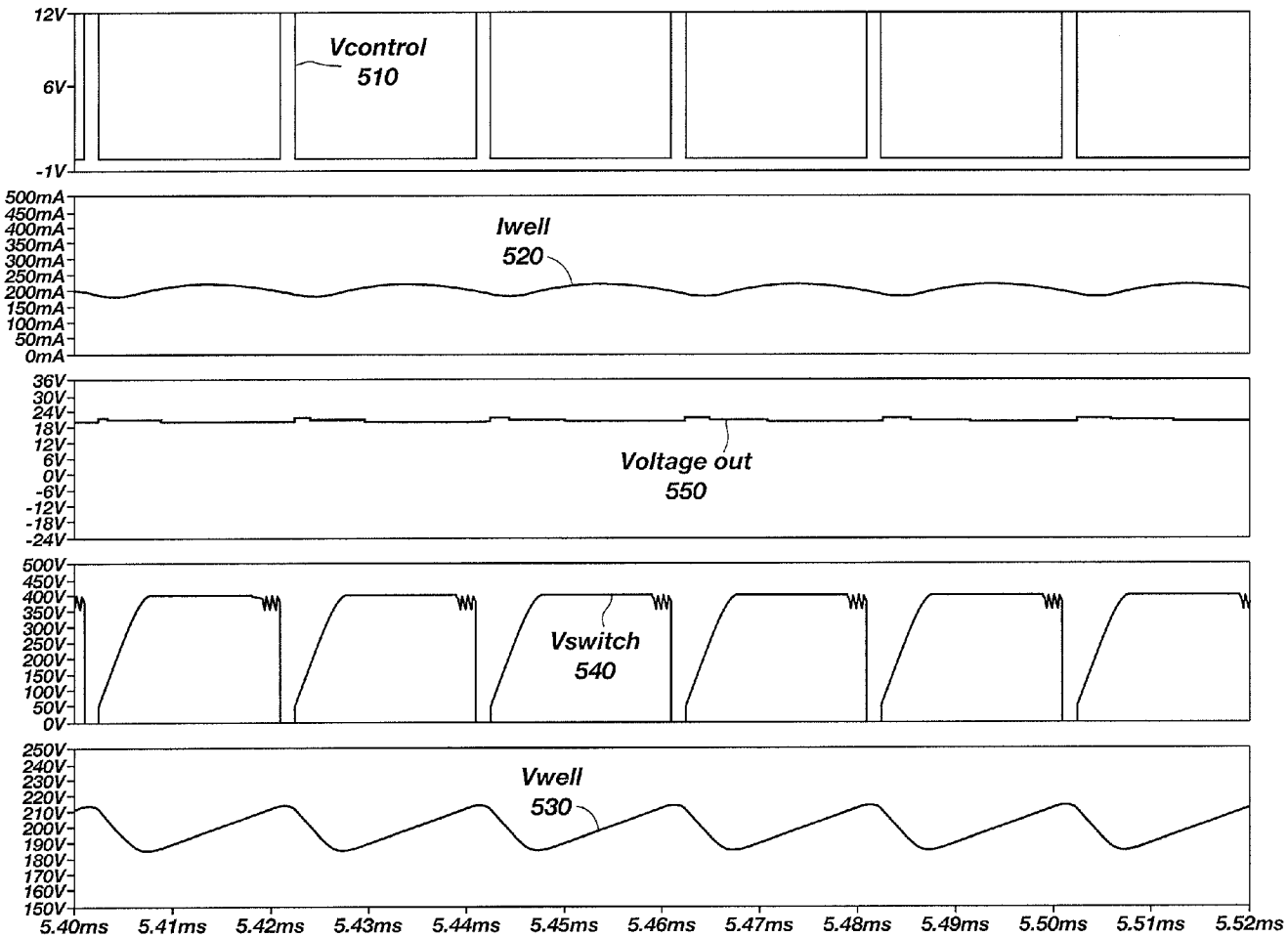
FIG. 5 is a plot of some analog signals of the circuit of FIG. 1 during a portion of a charging cycle for a charge storage device.

FIG. 5 is a plot of some analog signals of the fuze power conversion circuit 100 of FIG. 1 during a portion of a charging cycle for a charge storage device. Waveform 510 illustrates the pulse train on the control signal 135 in a manner similar to that of waveform 430 in FIG. 4. Waveform 520 illustrates the current being drawn from the filter well 140 at the output side 145. Waveform 530 illustrates the voltage on the output side 145 of the filter well 140. Waveform 540 illustrates the voltage above the switch M1 at the pulsed power signal 155. Finally, waveform 550 illustrates the voltage charging the charge storage device C4 at the power output signal 165.

When waveform 510 pulses high, the switch M1 closes and the pulsed power signal 155 is effectively coupled to ground as indicated by the low on waveform 540. When waveform 510 goes low, the switch M1 opens and current is drawn from the filter well 140 through the diode D1 and the second inductor L2. Thus, while waveform 540 is rising or at its high value of about 400 volts, the voltage on waveform 530 is increasing. Similarly, along with a phase shift due to the second inductor L2, the current on waveform 520 is increasing. While waveform 540 is at or near ground the voltage on waveform 530 is decreasing and, along with a phase shift, the current on waveform 520 is decreasing.

The voltage on waveform 540 is filtered and rectified by a combination of the resonance rectifier 160 and the charge storage device C4 to generate the voltage on the power output signal 165 as indicated by waveform 550.

Figure 6:
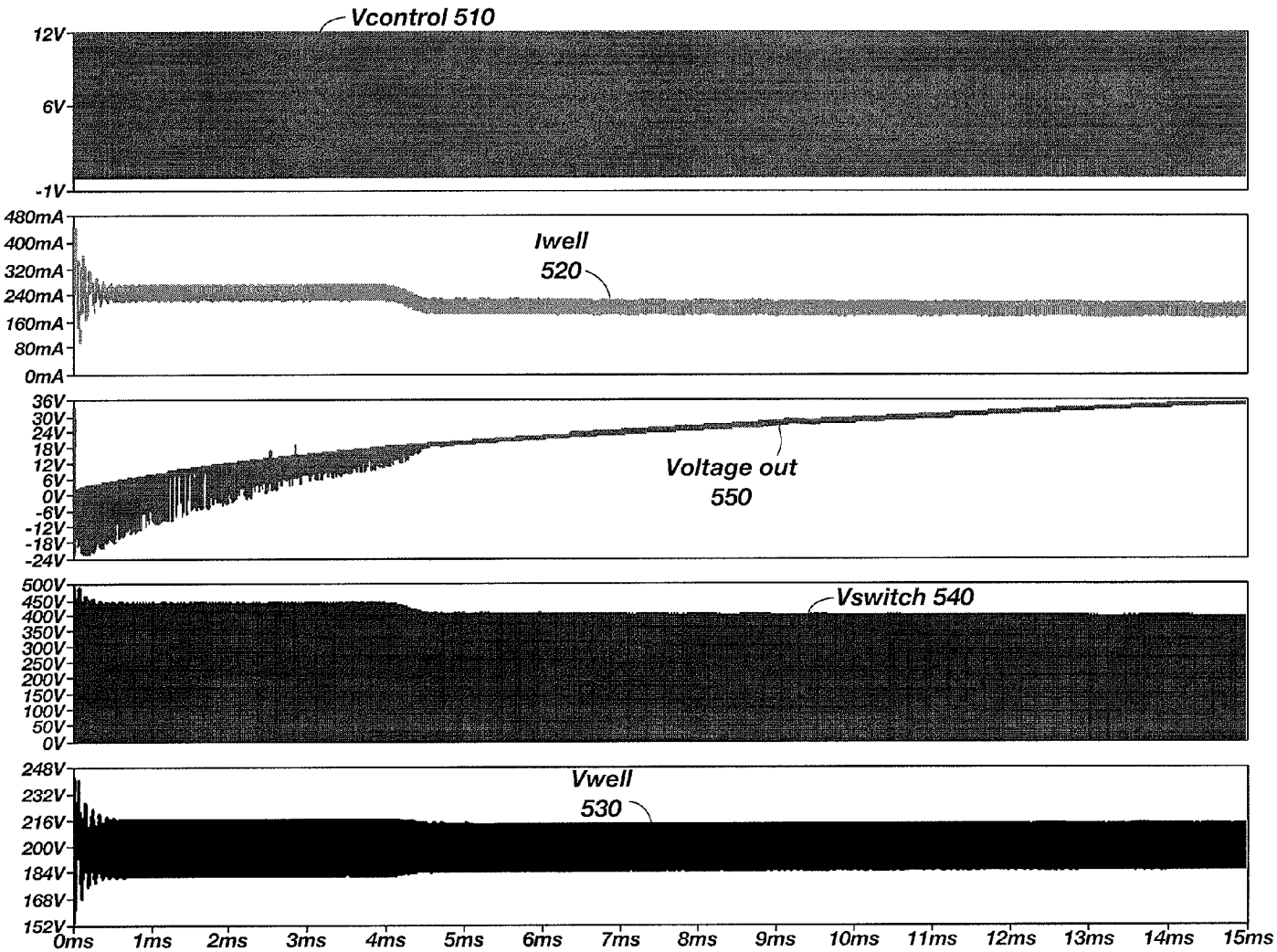
FIG. 6 is a plot illustrating a larger portion of the charging cycle illustrated in FIG. 5.

FIG. 6 is a plot illustrating a larger portion of the charging cycle illustrated in FIG. 5. The various waveforms are the same as those discussed above with reference to FIG. 5. However, the FIG. 6 plot shows a much longer time period so the oscillations in the various signals are shown as shaded portions of each waveform. The primary feature to be understood from FIG. 6 is that waveform 550 rises in a manner similar to that shown for waveform 230 of FIG. 2, indicating an efficient charging of the charge storage device C4.

Although the present invention has been described with reference to particular embodiments, the present invention is not limited to these described embodiments. Rather, the present invention is limited only by the appended claims and their legal equivalents.

What is claimed is:

1. A power conversion circuit, comprising:

a current monitor operably coupled to a power source signal for operable coupling to a power delivery element and configured for generating a source current indicator;

a controller configured to generate a control signal responsive to the source current indicator;

a filter well with an input side operably coupled to the power source signal;

an inductive switch circuit configured for switchably grounding a rectified inductive load coupled to an output side of the filter well responsive to the control signal to develop a pulsed power signal; and a resonance rectifier configured to present a substantially lossless resistive impedance for the pulsed power signal and rectify the pulsed power signal to charge a charge storage device and generate a power output signal;

wherein the filter well, the inductive switch circuit, and the controller are configured to maintain the source current indicator within a predetermined current range by filtering the pulsed power signal and adjusting at least one of a frequency and a pulse width modulation of the control signal responsive to the source current indicator.

2. The power conversion circuit of claim 1, wherein the filter well, the inductive switch circuit, and the controller are configured to maintain the source current indicator within the predetermined current range by adjusting the frequency of the control signal using an adjustment to modify a frequency of fixed width pulses on the control signal.

3. The power conversion circuit of claim 1, wherein the filter well, the inductive switch circuit, and the controller are configured to maintain the source current indicator within the predetermined current range by filtering the pulsed power signal and adjusting the frequency of the control signal or, alternatively, modifying an off-time pulse width of the control signal responsive to the source current indicator.

4. The power conversion circuit of claim 1, wherein the power source signal comprises a Direct Current (DC) pulse.

5. The power conversion circuit of claim 1, wherein the filter well comprises:

an inductor operably coupled in series between the input side and the output side;

a first capacitor operably coupled between the input side and a ground; and a second capacitor operably coupled between the output side and the ground.

6. The power conversion circuit of claim 5, wherein the controller is configured to adjust the control signal responsive to the source current indicator to maintain a magnetic field in the inductor.

7. The power conversion circuit of claim 1, wherein the inductive switch circuit comprises:

a diode with an anode operably coupled to the output side of the filter well; and an inductor operably coupled in series between a cathode of the diode and the switch.

8. The power conversion circuit of claim 7, wherein the switch comprises an n-channel transistor operably coupled between the inductor and a ground and includes a gate operably coupled to the control signal.

9. The power conversion circuit of claim 1, wherein the resonance rectifier comprises:

a capacitor with a first terminal operably coupled to the pulsed power signal;

an inductor operably coupled between a second terminal of the capacitor and a ground; and a diode forward biased between the second terminal of the capacitor and the rectified inductive load.

10. The power conversion circuit of claim 1, further comprising an analog-to-digital converter configured for converting the source current indicator to a digital current value.

11. The power conversion circuit of claim 1, wherein the current monitor is further configured to generate a first source current indicator to be asserted when a current of the power source signal is higher than the predetermined current range and a second source current indicator to be asserted when a current of the power source signal is not lower than the predetermined current range.

12. The power conversion circuit of claim 1, further comprising a voltage monitor operably coupled to the power source signal and configured for generating a source voltage indicator and wherein the controller further adjusts the control signal responsive to the source voltage indicator.

13. A power conversion circuit, comprising:

a current monitor operably coupled to a power source signal for operably coupling to a power delivery element and configured for generating a source current indicator;

a controller configured to generate a control signal responsive to the source current indicator;

a filter well with an input side operably coupled to the power source signal, the filter well comprising a pi-type filter with:

a first inductor operably coupled between the input side and an output side; and a first and second capacitor on each side of the first inductor;

a first diode with an anode operably coupled to the output side of the filter well;

a second inductor operably coupled to a cathode of the first diode;

a switch operably coupled in series between the first inductor and a ground;

a third capacitor operably coupled to the second inductor;

a third inductor operably coupled in series with the third capacitor; and a second diode with an anode operably coupled between the third capacitor and the third inductor.

14. The power conversion circuit of claim 13, wherein the controller is further configured to modify a frequency of pulses on the control signal responsive to the source current indicator.

15. The power conversion circuit of claim 13, further comprising a charge storage device operably coupled to a cathode of the second diode.

16. The power conversion circuit of claim 13, wherein the filter well, the first diode, the second inductor, the switch, and the controller comprise a feedback loop to maintain the source current indicator within a predetermined current range by filtering a pulsed power signal between the second inductor and the switch and adjusting at least one of a frequency and a pulse width modulation of the control signal responsive to the source current indicator.

17. The power conversion circuit of claim 16, wherein the current monitor is further configured to generate a first source current indicator to be asserted when a current of the power source signal is higher than the predetermined current range and a second source current indicator to be asserted when a current of the power source signal is not lower than the predetermined current range.

18. The power conversion circuit of claim 17, wherein the controller is further configured to:

maintain a pulse train frequency when the first source current indicator is negated and the second source current indicator is asserted;

reduce the pulse train frequency when the first source current indicator is asserted and the second source current indicator is asserted; and increase the pulse train frequency when the first source current indicator is negated and the second source current indicator is negated.

19. The power conversion circuit of claim 13, wherein the power source signal comprises a Direct Current (DC) pulse.

20. The power conversion circuit of claim 13, wherein the controller is configured to adjust a pulse train frequency of the control signal responsive to the source current indicator to maintain a magnetic field in the first inductor.

21. The power conversion circuit of claim 13, wherein the switch comprises an n-channel transistor operably coupled between the second inductor and the ground and includes a gate operably coupled to the control signal.

22. The power conversion circuit of claim 13, further comprising a voltage monitor operably coupled to the power source signal and configured for generating a source voltage indicator and wherein the controller is further configured to adjust a pulse train frequency of the control signal responsive to the source voltage indicator.

23. A method for converting power, comprising:

sensing a current of a power source signal to generate a source current indicator;

generating a variable frequency signal responsive to the source current indicator;

selectively coupling a rectified inductive load to a ground responsive to the variable frequency signal to generate a pulsed power signal;

maintaining the source current indicator within a predetermined current range by filtering the pulsed power signal relative to the power source signal and modifying a frequency of the variable frequency signal responsive to the source current indicator;

driving a substantially resistive impedance comprising at least one reactive component with the pulsed power signal;

rectifying the pulsed power signal after passing through the substantially resistive impedance; and charging a charge storage device with the rectified pulsed power signal.

24. The method of claim 23, wherein modifying the frequency of the variable frequency signal comprises adjusting a pulse train frequency on the variable frequency signal.

25. The method of claim 23, further comprising providing the power source signal as a Direct Current (DC) pulse.

26. The method of claim 23, further comprising:

asserting a first source current indicator when a current of the power source signal is higher than the predetermined current range;

asserting a second source current indicator when a current of the power source signal is not lower than the predetermined current range; and adjusting the frequency of the variable frequency signal responsive to the first source current indicator and the second source current indicator.

27. The method of claim 26, wherein the frequency of the variable frequency signal is:

maintained when the first source current indicator is negated and the second source current indicator is asserted;

reduced when the first source current indicator is asserted and the second source current indicator is asserted; and increased when the first source current indicator is negated and the second source current indicator is negated.

28. The method of claim 23, further comprising:

sensing a voltage of the power source signal to generate a source voltage indicator; and adjusting the frequency of the variable frequency signal responsive to the source voltage indicator.

29. The method of claim 23, further comprising supplying electrical power from the charge storage device to a fuze.

30. The method of claim 23, further comprising supplying electrical power from the charge storage device to an electric vehicle.

* * * * *